US006767291B1

(12) United States Patent
McCarthy

(10) Patent No.: US 6,767,291 B1
(45) Date of Patent: Jul. 27, 2004

(54) PUTTING DEVICE

(76) Inventor: Robert McCarthy, 4 Maple Ave., Box 0, Unadilla, NY (US) 13849

( * ) Notice: Subject to any disclaimer, the term of this patent is extended or adjusted under 35 U.S.C. 154(b) by 0 days.

(21) Appl. No.: 10/376,013

(22) Filed: Mar. 3, 2003

(51) Int. Cl.[7] ..... A63B 69/36
(52) U.S. Cl. ..... 473/220
(58) Field of Search ..... 473/219, 220, 473/223, 226, 257

(56) References Cited

U.S. PATENT DOCUMENTS 5,029,868 A * 7/1991 Cloud ..... 473/220
5,165,691 A * 11/1992 Cook ..... 473/220
5,169,150 A * 12/1992 Tindale ..... 473/220
5,213,331 A * 5/1993 Avanzini ..... 473/220
5,330,188 A * 7/1994 Reimers ..... 473/151
5,374,063 A * 12/1994 Ogden ..... 473/220
5,388,831 A * 2/1995 Quadri et al. ..... 473/220
5,435,562 A * 7/1995 Stock et al. ..... 473/220
5,464,221 A * 11/1995 Carney ..... 473/220
5,482,283 A * 1/1996 Wall ..... 473/220
5,630,764 A * 5/1997 McNair ..... 473/220
5,707,298 A * 1/1998 Chovanes ..... 473/223
5,709,610 A * 1/1998 Ognjanovic ..... 473/223
5,725,439 A * 3/1998 Halsey et al. ..... 473/220
5,725,440 A * 3/1998 Finney ..... 473/220
5,873,789 A * 2/1999 Torriano ..... 473/220
6,244,973 B1 * 6/2001 Eichelberger ..... 473/226
6,364,785 B1 * 4/2002 Chen ..... 473/222
6,450,893 B1 * 9/2002 Primiano et al. ..... 473/220
6,461,248 B1 * 10/2002 Gross ..... 473/220

* cited by examiner

*Primary Examiner*—Stephen P. Garbe
*Assistant Examiner*—Nini F. Legesse
(74) *Attorney, Agent, or Firm*—Mark Levy & Associates; David L. Banner

(57) ABSTRACT

A putting device and system for analyzing how a golfer addresses and strokes a golf ball. The putting device includes a plurality of lasers that are mounted on the putter. The laser project beams of light at the ball, at a target, and at a proximate side screen to show the accuracy and trueness of a putting swing.

7 Claims, 8 Drawing Sheets

PUTTING DEVICE

FIELD OF THE INVENTION

The present invention relates to golf equipment and, more particularly, to a putting device and system for observing, analyzing, and recording the swing and address of a golf ball by a putter.

BACKGROUND OF THE INVENTION

The game of golf enjoys mass appeal because it is a very entertaining pastime. However, many golf enthusiasts have trouble with certain aspects of their game. As such, there are many devices and systems for practicing the golf swing and address of the golf ball. One of the most vexing problems in golf is developing a consistent putting stroke. It is very frustrating for a golfer to reach the green in the required number of strokes and then three putt the golf ball.

The present invention seeks to provide an improved putting device and system for observing, analyzing, and recording the putting stroke and address of a golfer.

The current invention features a putter that has an attachable laser that casts a beam toward a target when simulating the path the putt is to be started on when a momentary switch is depressed. Using this device, the golfer is able to observe whether the face of the putter is aligned with the target so that he can squarely address the ball.

An impact switch attached to the club head is adapted to fire the laser when the ball is actually struck. The spot where the laser beam hits the target can then be compared to the previously aligned spot so that one can compare and/or analyze the accuracy of the stroke.

The target is a screen that is monitored by a charge coupled device (CCD) camera and can be used to record the results so that the golfer has a running record of his strokes. This is very much like observing the pattern of shots taken at a rifle firing range. A closely grouped pattern near the center of the target would obviously show that the golfer has a consistent and accurate putting stroke.

It is also contemplated to have a laser mounted on the putter head that is perpendicular to the direction of the stroke. The screen is then placed in front of the golfer beyond the ball. This laser is on continuously. The swing path is recorded as a series of dots as the CCD camera fires at 30 or more frames per second. The computer knows how fast the putter is traveling as it knows the distance between the dots and the difference in time between dots (1/30 sec). The computer can then connect the dots and show the swing path. The backswing and the downswing can be shown in different colors, showing the comparable speeds and paths.

In addition, a second laser can be mounted contiguous to the first, actuated by the impact switch and casting a beam on the screen at the point the ball is struck. A computer can record both the arc of the stroke and the point on the arc the ball was struck.

In another embodiment of the invention, an additional laser can be mounted to the putter head in line with the putter face and parallel to the ground, which projects a point onto a target. One can then analyze whether the putter is striking the ball while in the proper position.

It is also contemplated that the putter can be fitted with several differently mounted lasers. This will allow the golfer to observe and monitor a plurality of parameters that affect both the golf stroke and the address of the golf ball.

SUMMARY OF THE INVENTION

In accordance with the present invention, there is illustrated a golf putter device and system for analyzing the putting stroke and the addressing of the golf ball. The golf putter device comprises a putter that supports one or more lasers that project one or more light beams at targets mounted to the side of, ahead of, or upon the face of the golf ball. The system comprises cameras or other recording devices situated proximate the ball so that a continuous record can be maintained of the progress of the golfer. A switch mounted on the shaft or removably mounted on the club head of the putter can be used to actuate the various lasers. The lasers can either project a steady beam of light or can be pulse activated to provide a series of continuous dots.

It is an object of this invention to provide an improved golf putting device and system for analyzing the correctness and accuracy of the putting golf stroke.

It is another object of the invention to provide a golf putting system that uses lasers to analyze and improve the golf putting swing of a golfing enthusiast.

BRIEF DESCRIPTION OF THE DRAWINGS

A complete understanding of the present invention may be obtained by reference to the accompanying drawings when considered in conjunction with the subsequent detailed descriptions in which.

For purposes of brevity and clarity, like components and elements of the apparatus of this invention will bear the same designations or numbering throughout the figures.

DESCRIPTION OF THE PREFERRED EMBODIMENT

Generally speaking, the invention features a putting device and system for analyzing how a golfer addresses and strokes a golf ball. The putting device comprises a plurality of lasers that are mounted on the putter. The lasers project beams of light at the ball, at a target, and at a proximate side screen to show the accuracy and trueness of a putting swing.

Figure 1A:
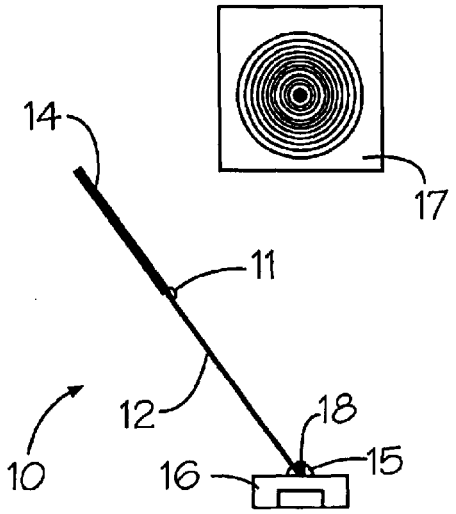
FIGS. 1*a* through 1*d* illustrate an in situ view of the golf device and system of this invention.
Figure 1B:
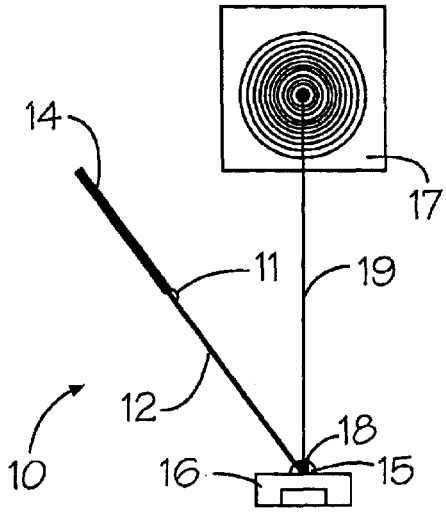

Now referring to FIG. 1*a*, a putter 10 of this invention is illustrated. The putter 10 has a shaft 12, a grip 14, and a club head 16. A laser 18 is mounted on the club head 16. The club head 16 of the putter 10 is shown in contact with a golf ball 15, and is being aligned with a distant target 17 in order to accurately hit the ball 15. The laser 18 can be actuated to send a light beam 19 toward the target 17, as shown in FIG. 1*b* indicating that the alignment is true. The laser 18 can be actuated in one of two ways: (a) by a switch 11 situated in proximity to the grip 14, or by an impact switch (not shown) disposed within the club head 16.

Figure 1C:
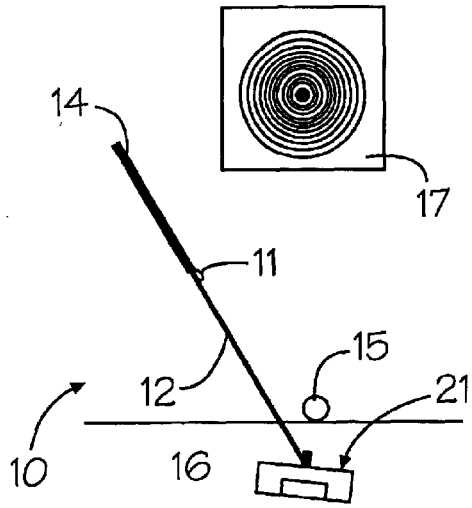
Figure 1D:
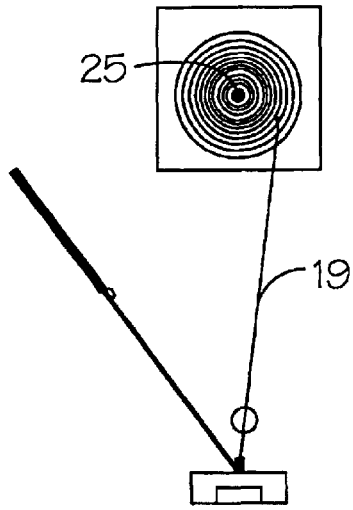

Referring to FIG. 1*c*, the face 21 of the club head 16 of the putter 10 is shown off-center with respect to the ball 15 and the target 17. The result of this misalignment is shown in FIG. 1*d* by the laser beam 19 that strikes the target 17 to the right of the bulls-eye 25.

Figure 2:
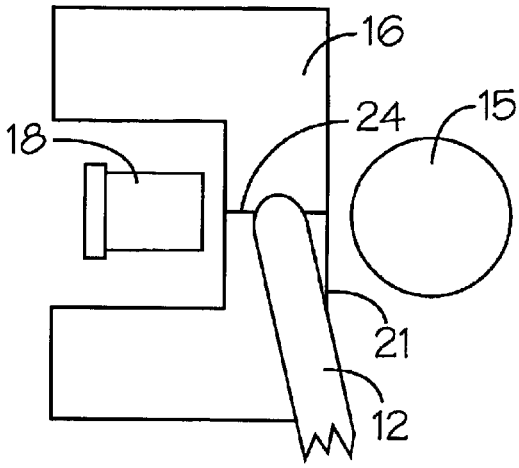
FIG. 2 depicts a top, enlarged view of the club head of the inventive putter, illustrated in FIGS. 1*a* through 1*d;*

Referring to FIG. 2, an enlarged top view of the club head 16 is shown. The laser 18 sends a light beam (not shown) through a hole or slit 24 in the club head 16. The light beam will be directed over the top of the ball 15 towards the target, not shown here. The laser is above the club head, as it is illegal to have a slit or hole in the club head. It is also removable.

Figure 3:
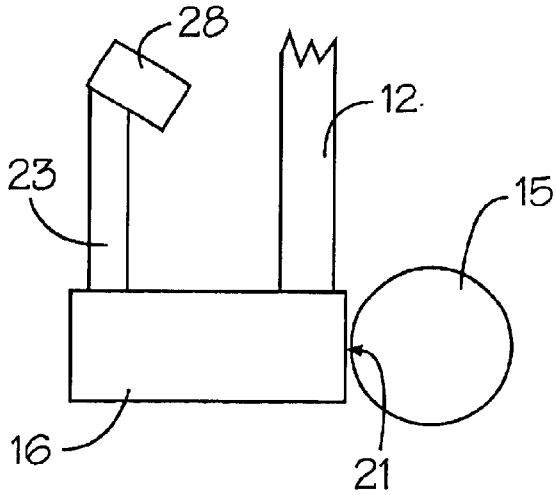
FIG. 3 shows a side, enlarged view of a second embodiment of the club head of the inventive putter, illustrated in FIG. 2.
Figure 4:
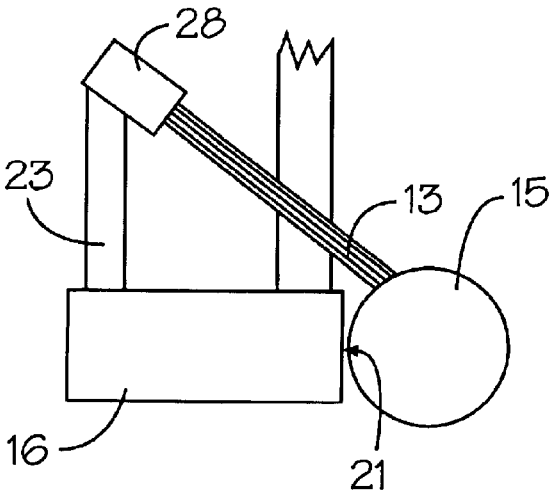
FIG. 4 illustrates a side, enlarged view of a laser beam projected onto a golf ball with the putting device shown in FIG. 3.

In another embodiment, as observed in FIGS. 3 and 4, a laser 28 can be mounted above the club head 16 by means of a post 23. The laser 28 is designed to direct a beam of light 13 downwardly at the ball 15 so that the golfer will be able to ascertain whether the club head face 21 is squarely aligned with the ball 15.

Figure 5A:
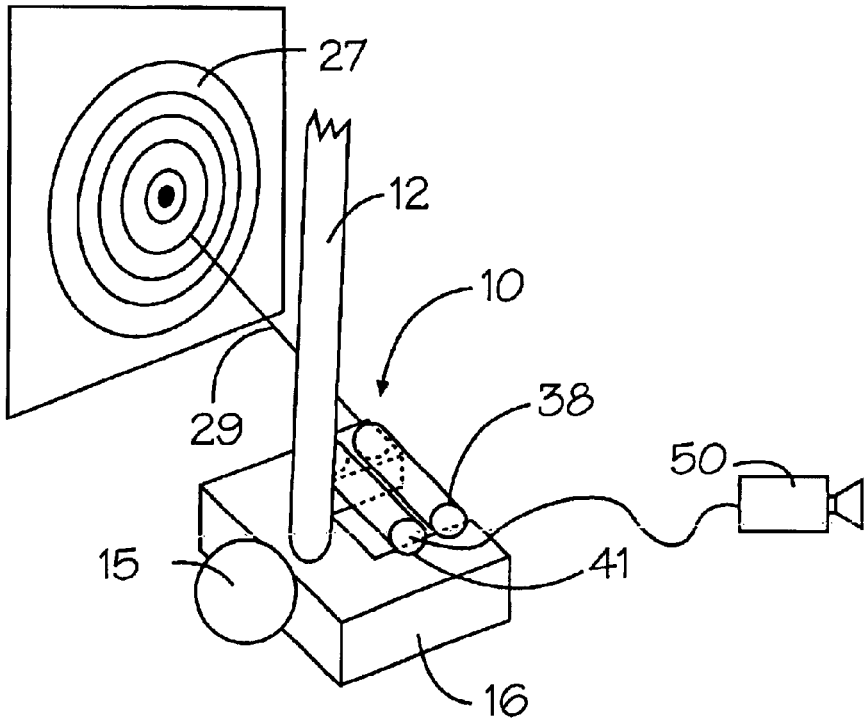
FIGS. 5*a* through 5*e* depict a series of perspective, in situ views of the golf device of this invention in a golf swing analyzing mode.
Figure 5B:
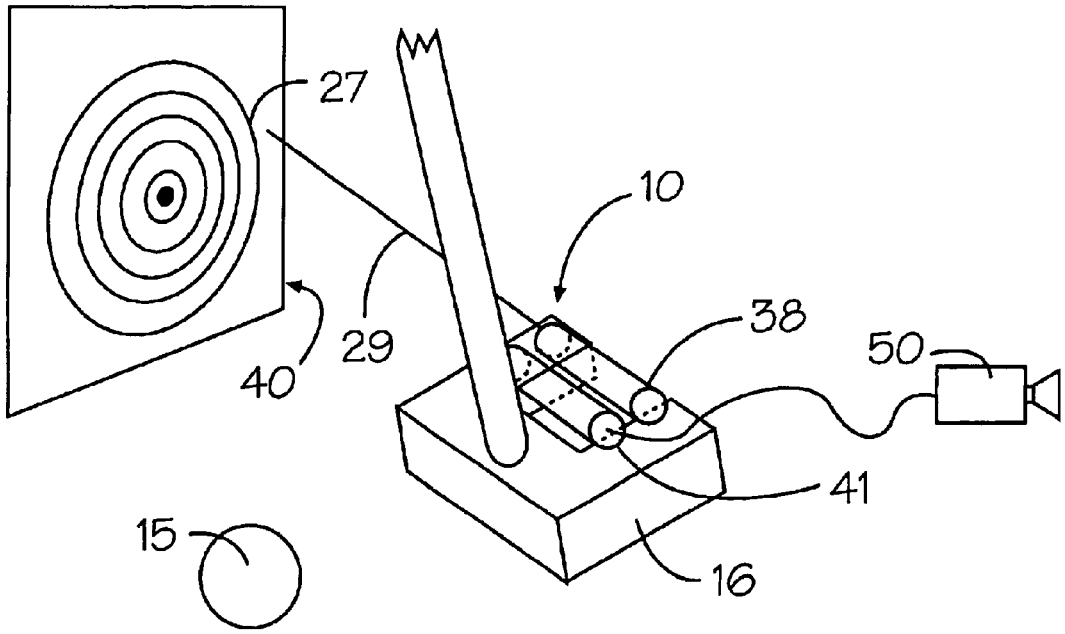

Referring to FIGS. 5*a* through 5*e*, another embodiment of this invention is illustrated. In this embodiment, a laser 38 is disposed on the club head 16 perpendicular to the ball 15 and projects a light beam 29 at a side target 27. As the putter 10 is drawn back to swing and make contact with the ball 15, as shown in FIG. 5*b*, the laser beam 29 reaches the edge 40 of the target 27.

Figure 5C:
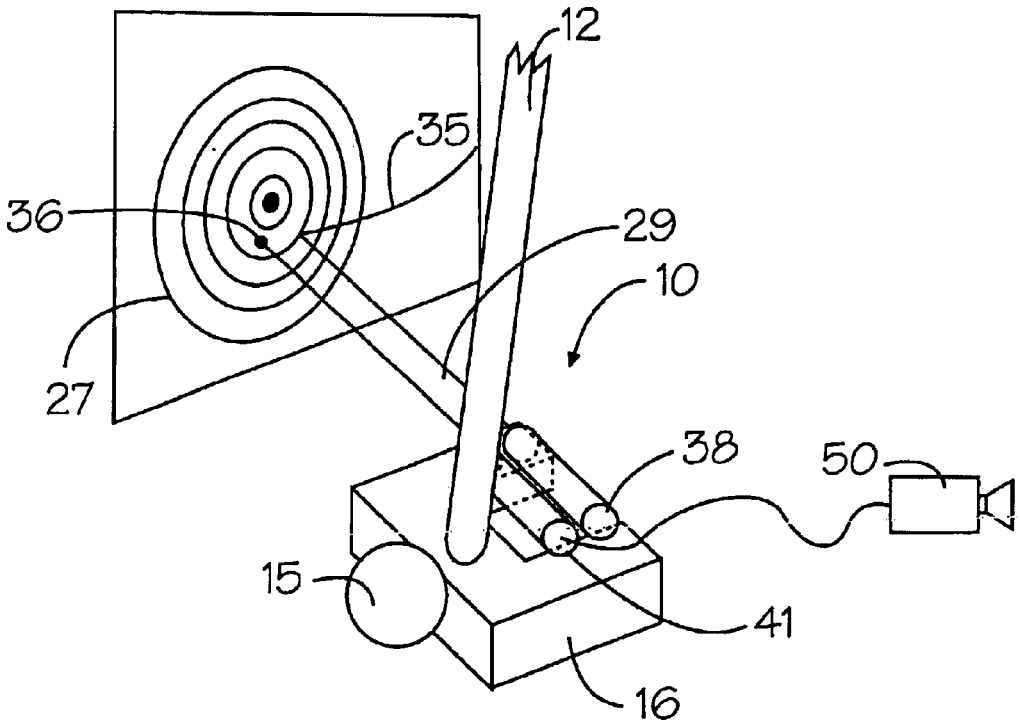
Figure 5D:
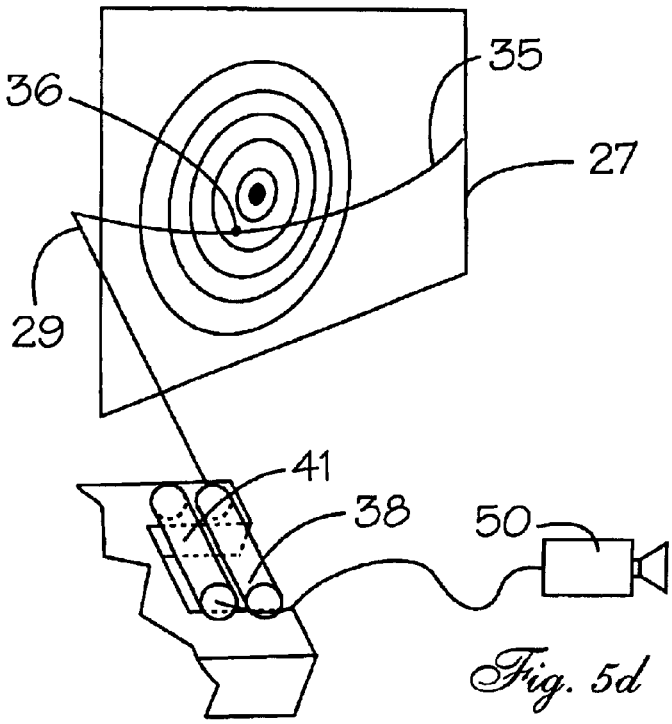
Figure 5E:
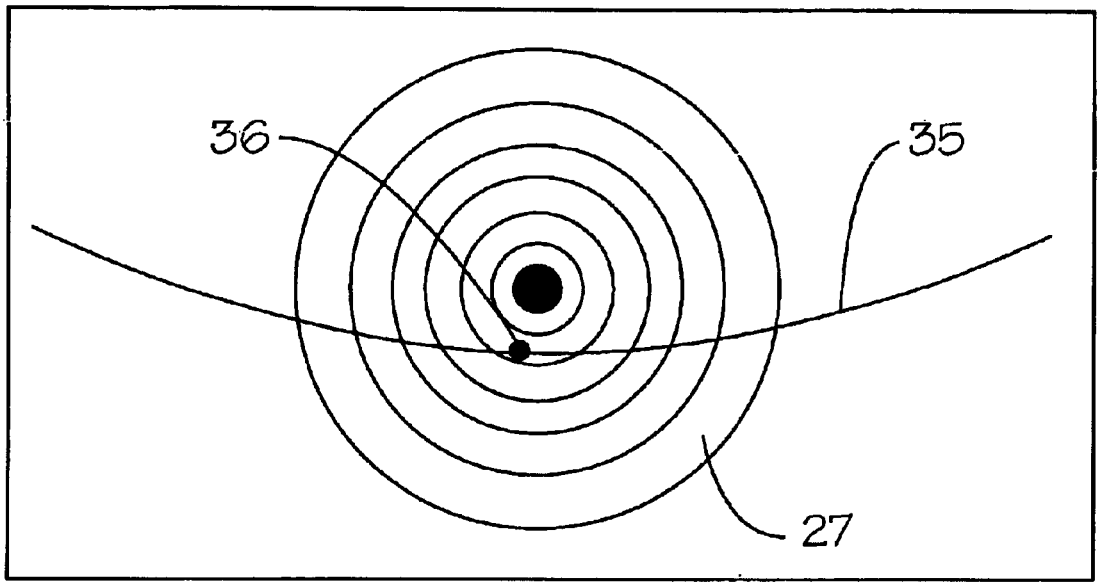
Figure 6A:
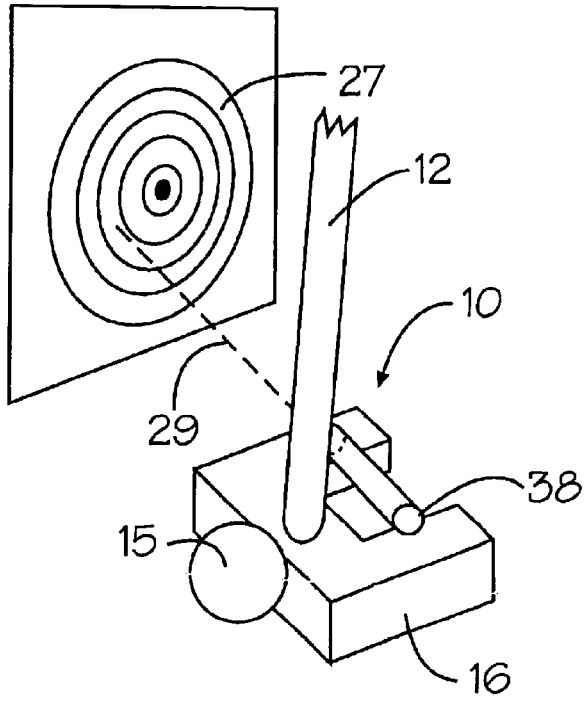
FIGS. 6*a* through 6*e* depict a series of perspective, in situ views of the golf device of this invention in a golf swing analyzing mode using a laser.
Figure 6B:
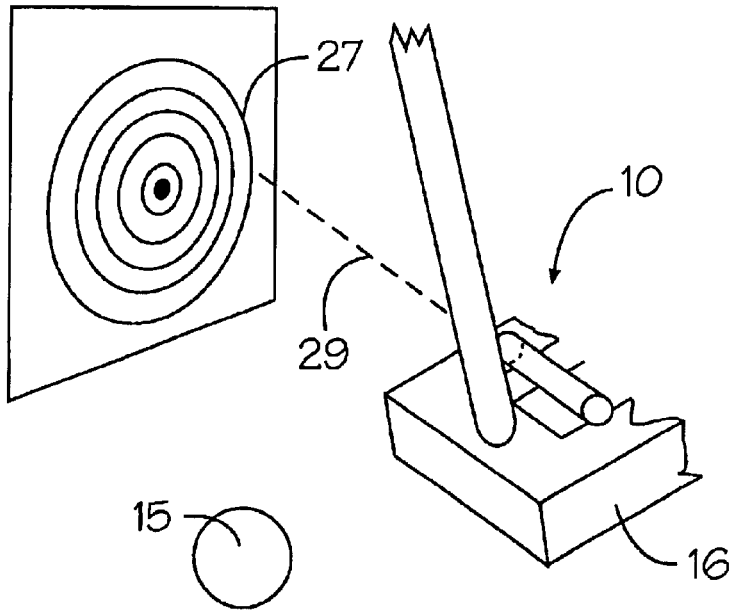
Figure 6C:
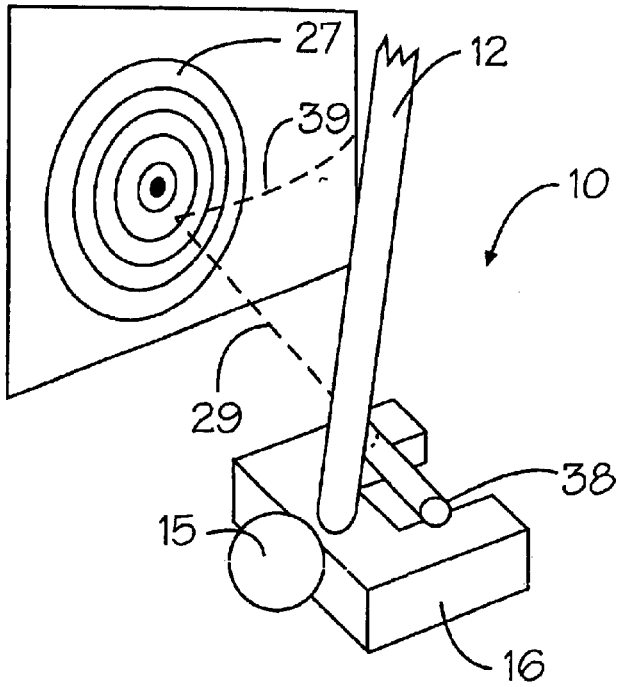
Figure 6D:
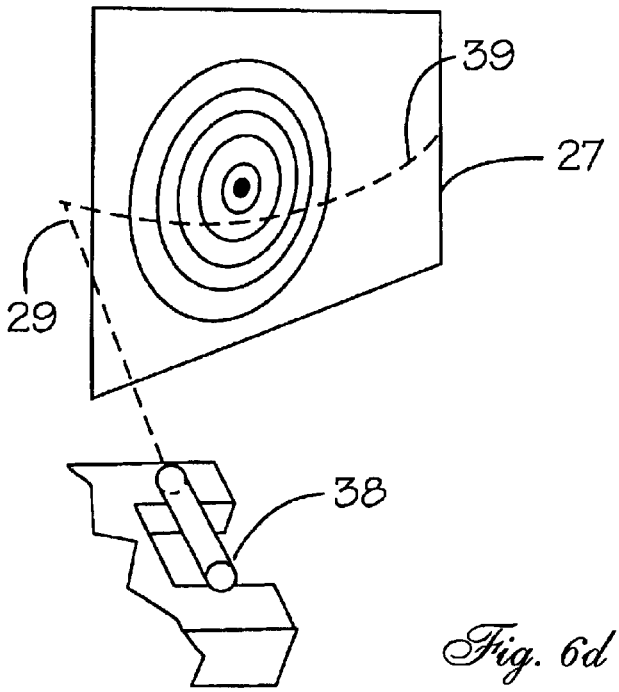
Figure 6E:
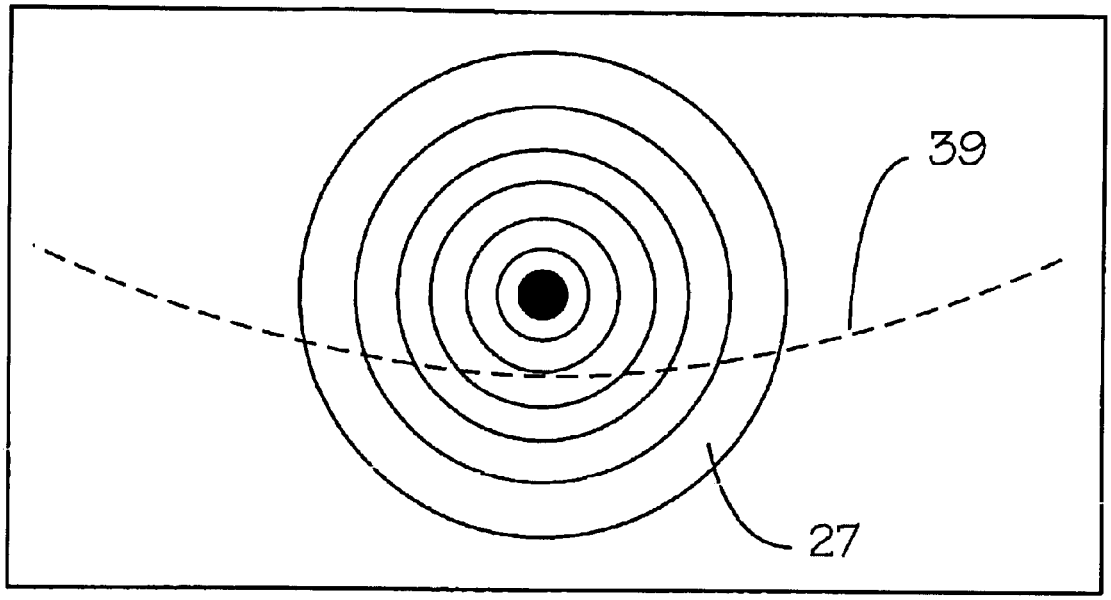

As the club head 16 is stroked forward to contact the ball 15 and the club head 16 moves through its follow through, as illustrated in FIGS. 5*c* through 5*e*, an arcuate beam 35 is caused to be drawn across the target 27. When the club head 16 makes contact with the ball 15, a second laser 41 projects a point 36 on target 27. A recording device 50, such as a CCD camera, can record the beam thus giving the golfer an indication of where in the arc the ball is contacted, which would increase or decrease the effective loft of the putter.

In another embodiment, as depicted in FIGS. 6*a* through 6*e*, the CCD camera 38 can be pulsed at 30 frames/second in a preferred embodiment, or laser 38 can be controlled by electric circuitry 50 disposed in the club head 16, such that the arcuate beam can be shown as a continuous series of dots 39. Knowing the time interval between dots and the distance between the actual dots, the speed of the club head can be ascertained.

Since other modifications and changes varied to fit particular operating requirements and environments will be apparent to those skilled in the art, the invention is not considered limited to the example chosen for purposes of disclosure and covers all changes and modifications which do not constitute departures from the true spirit and scope of this invention.

Having thus described the invention, what is desired to be protected by Letters Patent is presented in the subsequently appended claims.

What is claimed is:

1. A golf device for aiding a golfer with his putting technique, comprising:

a putter having a club head, a shaft, and a grip, said club head having a club face for addressing a golf ball;

at least one laser supported by the club head for projecting a light beam that indicates the alignment of the club face with the golf ball;

an impact switch attached to said club head, and a switch carried by said putter proximate said grip, both operatively connected to said laser for the selective actuation thereof when said club head strikes said golf ball and when manually actuated by a golfer, respectively; and wherein said at least one laser projects a beam of light substantially perpendicularly to said club face towards a two-dimensional, passive golf target disposed at a distance from said face and substantially parallel to said club face.

2. The golf device in accordance with claim 1, wherein said at least one laser projects a beam of light towards a golf ball disposed contiguous to said club face.

3. The golf device in accordance with claim 1, wherein said at least one laser projects a pulsed beam of light.

4. A golf device for analyzing a golf putting technique, comprising:

a putter having a club head, a shaft, and a grip, said club head having a club face for addressing a golf ball and making contact therewith;

at least one laser supported by the club head for projecting a light beam that indicates the alignment of the club face with a distant, two-dimensional, passive target;

an impact switch attached to said club head, and a switch carried by said putter proximate said grip, both operatively connected to said laser for the selective actuation thereof when said club head strikes said golf ball and when manually actuated by a golfer, respectively; and wherein said at least one laser projects a beam of light substantially perpendicularly to said club face towards a two-dimensional, passive golf target disposed at a distance from said face and substantially parallel to said club face.

5. The golf device in accordance with claim 4, wherein said at least one laser projects a beam of light toward a golf ball disposed contiguous to said club face.

6. The golf device in accordance with claim 4, wherein said at least one laser projects a pulsed beam of light.

7. A golf analyzing system, comprising:

a putter having a club face and supporting at least one laser that projects a beam of light substantially perpendicularly to said face;

a two-dimensional, passive target disposed at a distance from the putter and substantially parallel to said club face, and receiving said beam of light from said laser on said surface thereof; and means operatively connected to said target for recording the position of said received beam of light on said face of said target in order to analyze a putting swing.

* * * * *